US006626414B1

(12) United States Patent
Murphy

(10) Patent No.: US 6,626,414 B1
(45) Date of Patent: Sep. 30, 2003

(54) CONCRETE CASTING SLIDING CORNER SYSTEM

(75) Inventor: Robert L. Murphy, Jacksonville, FL (US)

(73) Assignee: GDS Group Limited, Tortola (VG)

( * ) Notice: Subject to any disclaimer, the term of this patent is extended or adjusted under 35 U.S.C. 154(b) by 0 days.

(21) Appl. No.: 09/344,475

(22) Filed: Jun. 25, 1999

(51) Int. Cl.[7] ..... B28B 7/30
(52) U.S. Cl. ..... 249/152; 249/180
(58) Field of Search ..... 249/152, 180

(56) References Cited

U.S. PATENT DOCUMENTS 2,836,875 A * 6/1958 Chandler et al. ..... 249/180
3,206,155 A * 9/1965 Nottingham et al. ..... 249/180
3,811,646 A * 5/1974 Beasley ..... 249/180
3,815,864 A * 6/1974 Loeber ..... 249/180
4,029,287 A * 6/1977 Burdett ..... 249/180
4,300,746 A * 11/1981 Schoen ..... 249/180
4,519,570 A * 5/1985 Strickland et al. ..... 249/180
4,570,896 A * 2/1986 Strickland et al. ..... 249/180
4,614,326 A * 9/1986 Strickland et al. ..... 249/180
4,679,762 A * 7/1987 Lee ..... 249/180
5,230,907 A * 7/1993 Strickland ..... 249/180
5,524,861 A * 6/1996 Solomon ..... 249/152
6,105,924 A * 8/2000 Carr ..... 249/180

* cited by examiner

*Primary Examiner*—James P. Mackey
(74) *Attorney, Agent, or Firm*—Arthur G. Yeager

(57) ABSTRACT

A concrete casting sliding corner system includes a pallet for defining the cross-sectional shape and thickness of the sidewalls and an inside core mold disposed interiorly of the pallet and an outside mold jacket disposed outwardly of the pallet. The mold core and mold jacket are movable between an open release position and a closed casting position. A corner forming section includes a wedge-shaped member movable vertically between an upward casting position and a downward release position. Alignment means is included to coordinate the corner wedge and members of the mold core to prevent misalignment due to lack of coordination between the interior mold components.

20 Claims, 10 Drawing Sheets

CONCRETE CASTING SLIDING CORNER SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention pertains to a method and apparatus for the molding of a four or five sided, monolithic, seamless, concrete casting.

2. Related Art

A wide variety of molding techniques exist for the purpose of creating a monolithic concrete unit used in water systems and the like. What is desired is an apparatus that will greatly reduce the likelihood of damage to the product, particularly interior corners. The usual way of removing corner-forming mold sections is to retract them inwardly in a horizontal direction. It has been found that such movement may cause the fracturing of the casting due to misalignment and lack of coordination between the corner-forming sections and side panels.

BRIEF SUMMARY OF THE INVENTION

In one aspect of the present.invention there is provided an apparatus for integrally casting a multi-sided monolithically poured concrete module having a plurality of side walls comprising a pallet for defining the cross-sectional shape and thickness of the side walls, an inside mold core disposed interiorly of the pallet and including a plurality of interior panels having opposite end portions for molding inside surfaces of the side walls. A plurality of corner forming sections are included with each being located between respective opposite end portions of two adjacent interior panels for molding inside surfaces of side walls and corners formed thereby of a concrete module. There are means for moving the interior panels inwardly and the corner forming sections outwardly and upwardly, and inwardly and downwardly between a closed casting position and an open release position. The inside mold core abuts against the pallet in the closed casting position and is movable to the open release position. Alignment means are attached between an adjacent interior panels and adjacent corner forming section in alignment during movement of the corner forming section. An outside mold jacket is disposed outwardly of the pallet and includes a plurality of exterior panel members cooperatively arranged to generally envelope the pallet and the inside mold core for molding outside surfaces of side walls of a concrete module. Means are included for moving each exterior panel member between a closed casting position abutting the pallet and an open release position away from the pallet, the outside mold jacket and the inside mold core defining a mold cavity therebetween for receiving the concrete when the mold core and the mold jacket are in the closed casting positions.

In other aspects of the present invention each forming section includes a movable corner member for forming an interior concrete corner, the means for moving the interior panels and the corner forming section including means for moving the corner member substantially vertically upward to the closed casting position and substantially vertically downwardly to the open release position. The means for moving the corner member includes a hydraulic cylinder attached between the corner member and another part of the apparatus. The corner forming section also includes means for movably attaching the corner forming section to each adjacent interior panels. Means for moving the interior panels and the corner forming sections includes means for moving each corner forming section substantially vertically upwardly and outwardly to a closed casting position and substantially vertically downwardly and inwardly to an open release position.

Further advantages of the present invention are seen by each of the movable corner forming sections having a movable wedge-shaped element with an upper apex portion and a lower base portion with a width greater than the apex portion and two slanted edges and a pair of connection plate members each having a slanted edge portion adjacent one slanted edge portion of the element and another substantially vertical edge portion attached to one end portion of one interior panel. Engaging means are provided for slideably connecting one slanted edge portion of one connection plate member for causing the interior panels attached to the connection plate to the moved inwardly when the element is moved substantially vertically downwardly to the open release position and for causing the interior panels to be moved outwardly when the element is moved substantially vertically upwardly to the closed casting position. The alignment means includes an elongated bar member having opposite end portions and means for movably mounting each end portion of the bar member to a respective interior panel, the bar member being mounted generally horizontally. The means for movably mounting includes a pair of generally horizontally extending slots and cooperating fixed bolts located through the slots. The engaging means includes at least one elongated slot in one slanted edge portion and at least one or more bolt extending through the slot and movably therealong. The means for moving the interior panels and the corner forming sections includes lubricating means for lubricating between the corner forming sections and the respective opposite end portions of the adjacent interior panels and particularly for lubricating between the slanted edge portions of the element and the connection plate. There is also sealing means attached between the slanted edge portion of one element and the slanted edge portion of the respective connection plate to inhibit grout and debris entering the engaging means.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
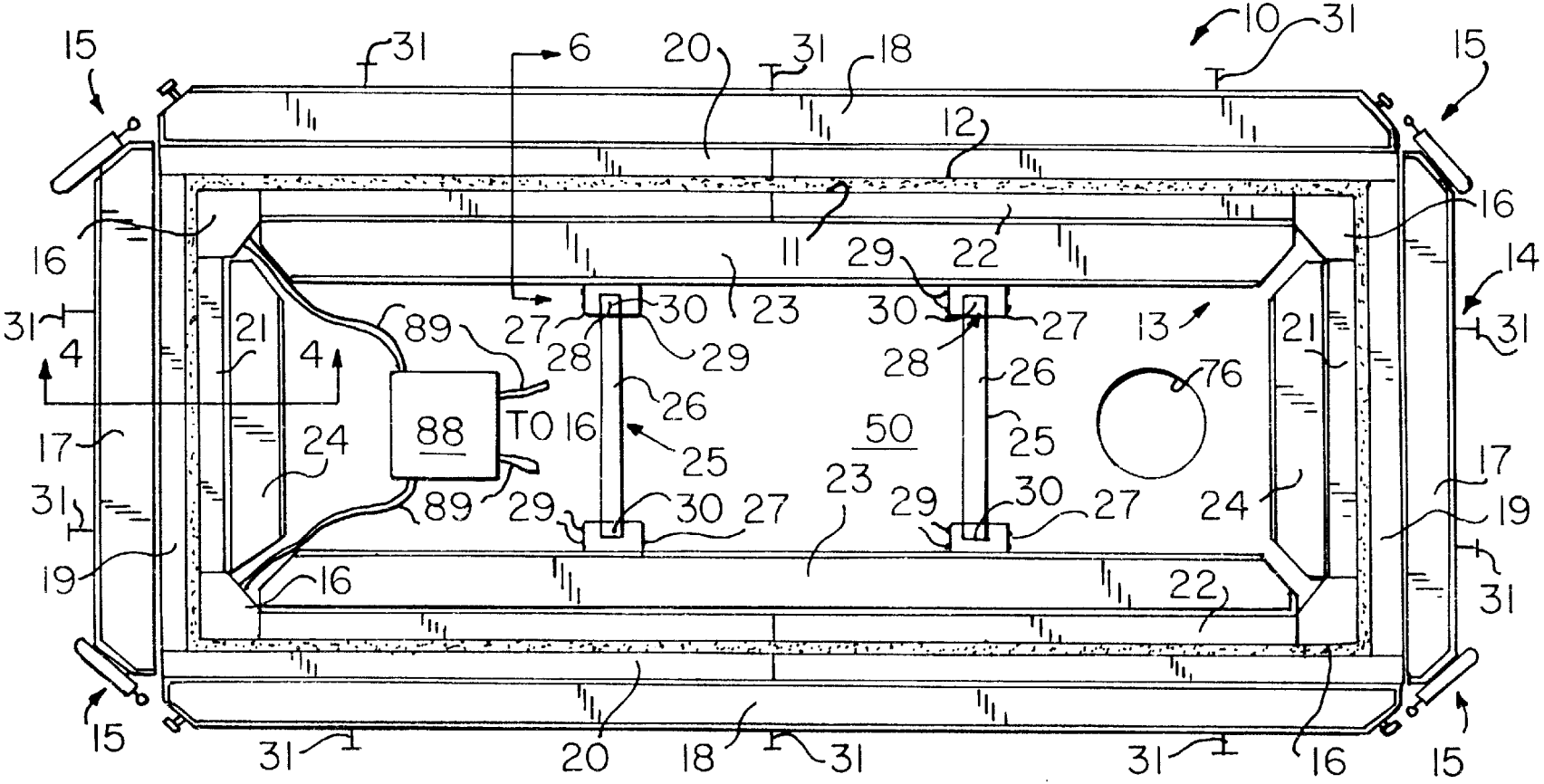
FIG. 1 is a top view of the casting apparatus in accord with the present invention in the closed casting position and without a lid.
Figure 2:
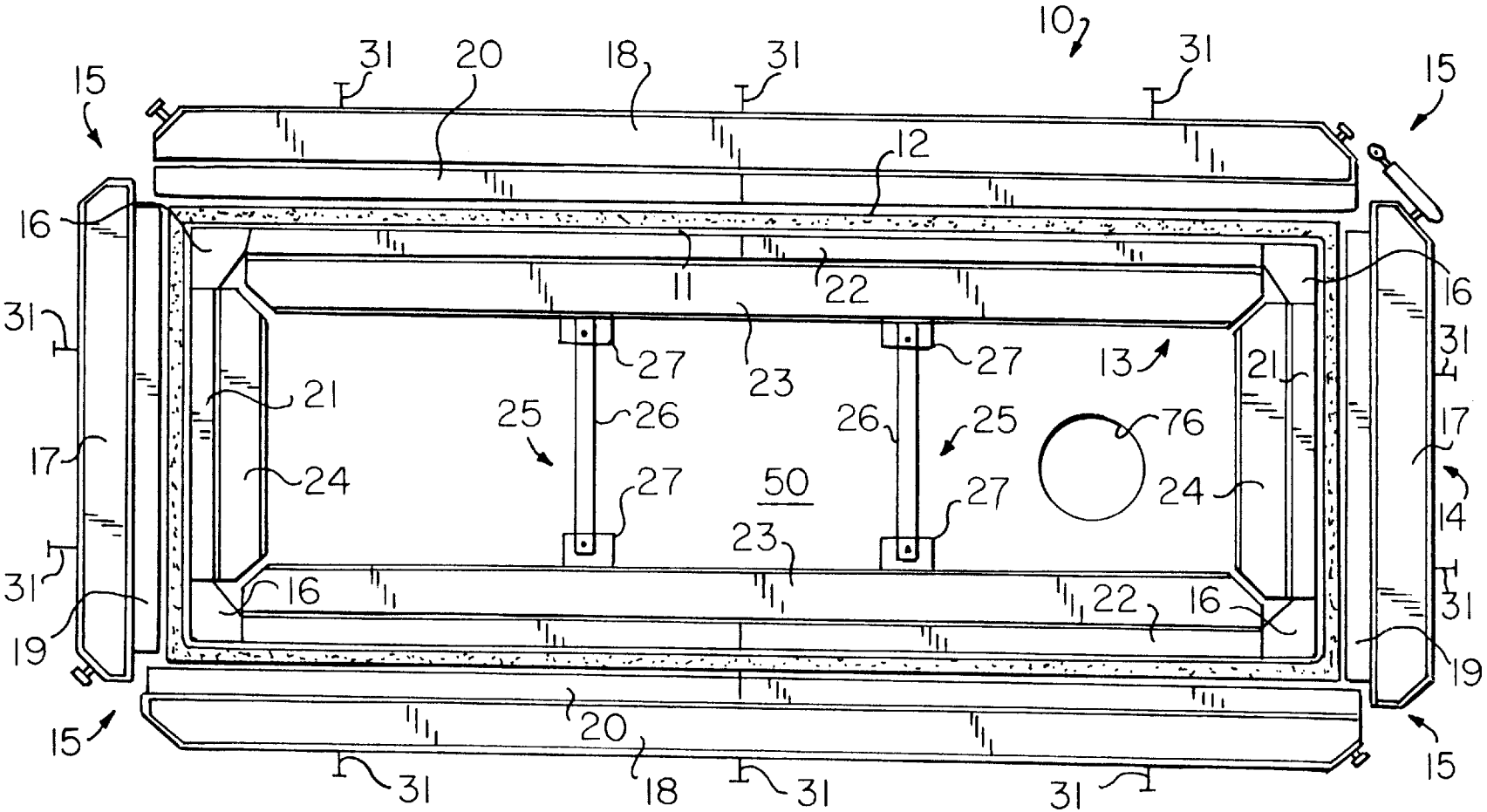
FIG. 2 is a top view of the casting apparatus of FIG. 1 in the open release position.

With respect now to the drawings, the mold system in accord with the present invention is shown generally at 10 in FIGS. 1 and 2, mold cavity 11 is formed to hold concrete casting or module 12 by interior core mold apparatus 13 and exterior mold jacket apparatus 14 which includes a plurality of securing means such as latches 15 (only one shown in FIG. 2). Interior mold 13 includes four corner sections 16 whose location is shown in FIGS. 1 and 2. The exterior jacket apparatus 14 includes end exterior walers 17 and side exterior walers 18 held in place by exterior columns 31. End exterior forming panels 19 and side exterior forming panels 20 provide the exterior support for casting 12.

In FIG. 1 the mold 10 is shown in the closed or forming position. In FIG. 2 the mold 10 is in the opened or released position. Inside mold apparatus 13 includes end interior walers 21 and side interior walers 22 with corresponding end and side interior forming panels 24 and 23 respectively. The entire apparatus 10 is shown as rectangular mold. The mold may also be square if desired.

A plurality of interior support members 25 include horizontal braces 26 with end brackets 27 that are bolted via holes 28 and bolts 30. Side-mounted bolts 29 fit in slightly elongated holes and are loosened to allow the length of a support member 25 to shorten slightly when the interior mold apparatus 13 is contracted to release the mold. When the apparatus 10 is closed for molding the support members 25 push outwardly against side interior walers 23 and are rigid to hold the mold closed when vibrators to settle concrete 12 are used. The specific construction and number of members 25 employed depends upon the size of the mold and associated casting. The specific construction details of interior core apparatus 13 and exterior jacket apparatus 14 may vary depending on the size of the mold being made. Latches 15 may be replaced with a nut and bolted flange in the case of a high (8' or more) molding in order to provide greater holding force.

Figure 3:
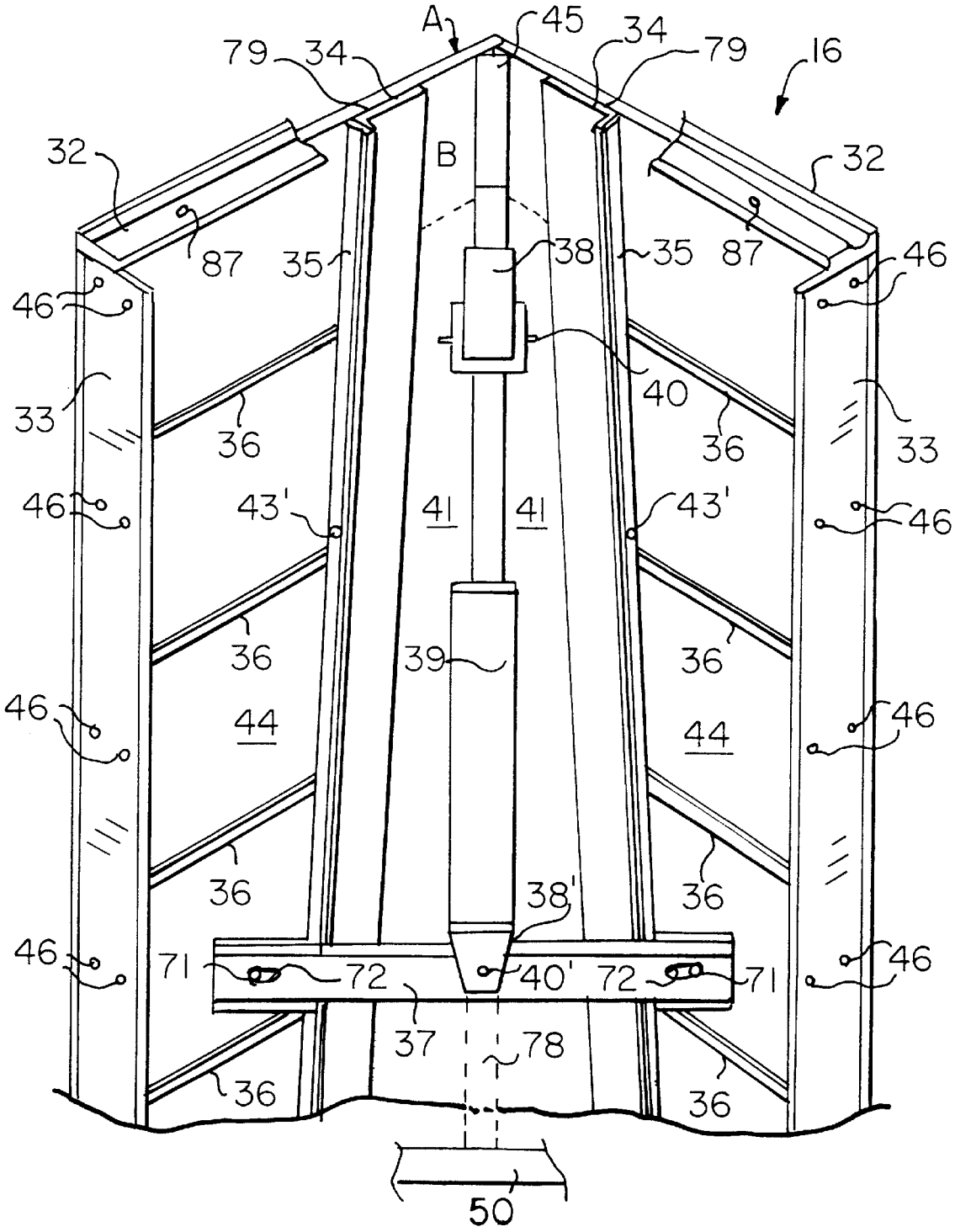
FIG. 3 is a pictorial view of a corner framing section of the apparatus of FIGS. 1 and 2.
Figure 7:
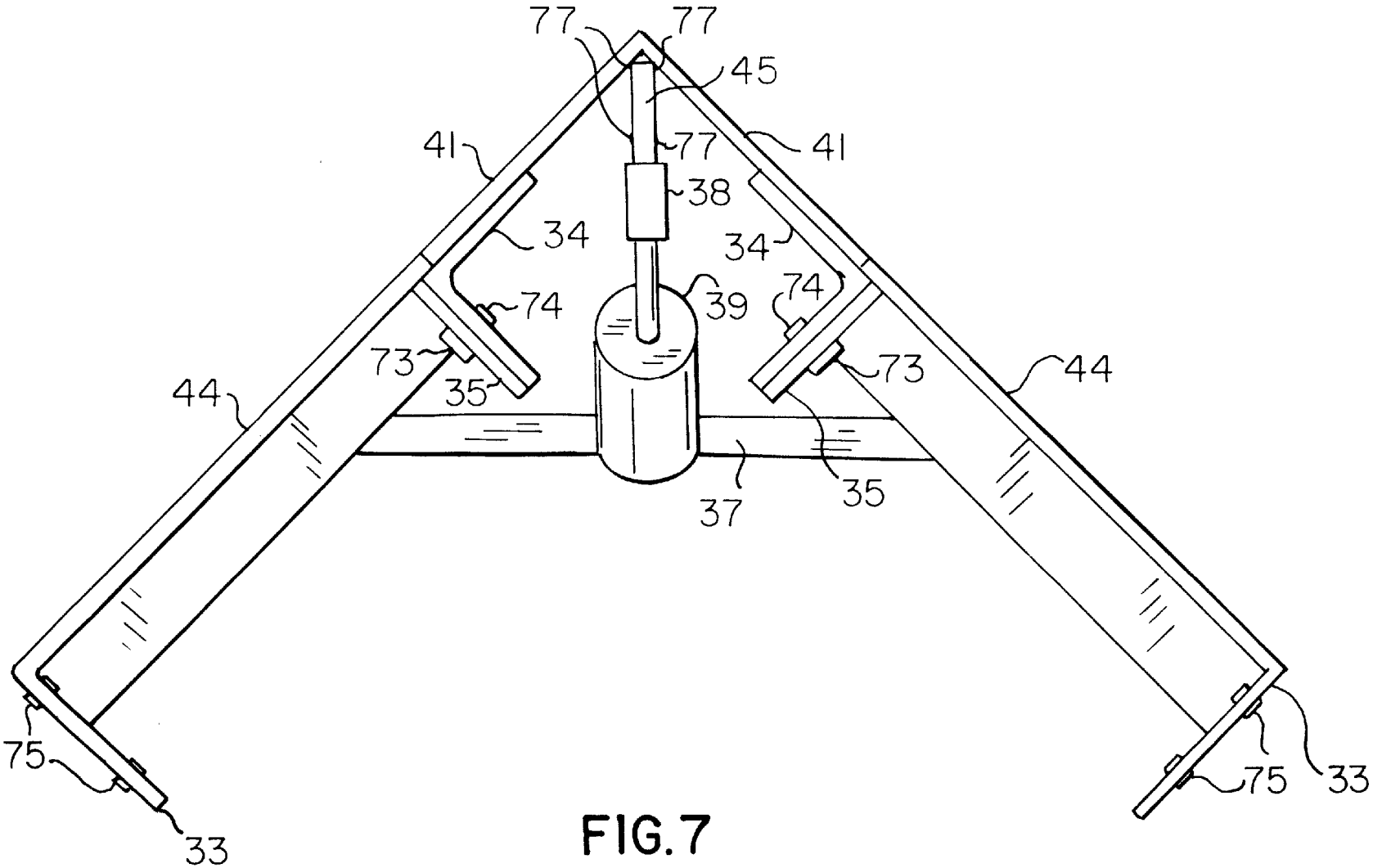
FIG. 7 is a top view of the corner forming section of the apparatus of FIGS. 1 and 2.
Figure 8:
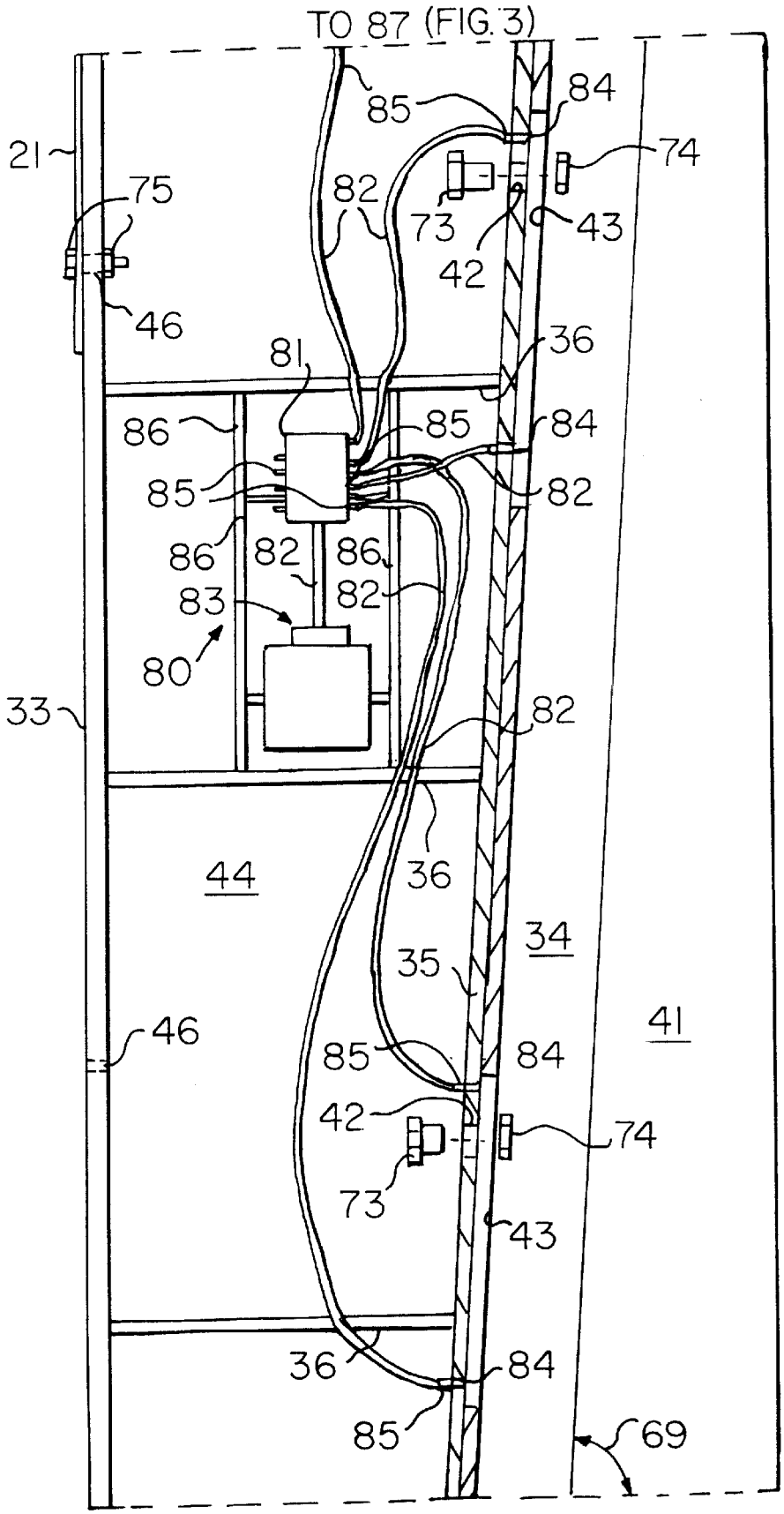
FIG. 8 is a side elevation view of a portion of the corner forming section of FIGS. 1–3, and 7.

In FIGS. 3, 7 and 8, a corner forming sliding section 16 is illustrated. The present invention provides a corner section 16 that moves downwardly and away from the cast product when the mold 10 is opened. The resultant shearing process is fast and greatly reduces the risk of damage to the concrete mold 12.

Grease rail 32 is mounted on top of side connection plate 33 and support beam 54 (FIG. 6) to provide for placing a lid 53 having chamfer 56 on the apparatus to mold top 55. A slide angle plate 34 with spaced slotted holes 43 is connected to slide bar 35 which has spaced holes 42 into which are inserted slide nut and bolt fasteners 73, 74. The jacket stiffener bars 36 are used to provide for structural rigidity of ear side skin plates 44. Cross tie squaring bar 37 supports hydraulic (or pneumatic) cylinder assembly 39 via bolts 40 and 40' and is mounted to apparatus base 50 in the case of short molds via any appropriate apparatus 78. Clevis pin bracket 38 and 38' connects double-acting cylinder assembly 39 between base and slide skin plate 41 to which it is welded at the corner flat bar 45 at points 77 and allows for slight inward and outward movement of section 16. Holes 46 and bolts and nuts 75 are used to connect plates 33 to interior forming panels 21 and 22, which are supported above base 50 and freely movable during contraction and expansion of the mold 13.

Slide skin plate 41 is welded to slide angle plate 34, which overlaps the junction between plates 41 and 44 to assist in keeping grout out of the apparatus and specifically to inhibit grout from entering between sliding plates 34 and 35. Slide skin plate 41 is moved upwardly to be placed in position to form a concrete mold and pulled downwardly to release or strip the mold. As shown in FIGS. 3 and 8, the downward movement of plates 34 and 41 from arrow A to arrow B will cause the side connection plate and attached interior panels 21 and 22 to be pulled inward toward the corner section 16 because the skin plate 41 gets wider at the lower end. The angle 69 as seen in FIG. 8, determines the amount of inward contraction movement. This action results because plates 34 and 35 are movably secured together via bolts 73 and Teflon coated nuts 74. As plate 34 moves downwardly it will encounter the end of slot 43 which functions as a travel limit.

The movement downwardly of corner section plates 34 and 41 will result in inward movement of interior panels 21 and 22 as they are pulled closer to corner section 16 which also moves inwardly with them. The overall result is an open position of the interior mold 13 resulting from the overall "shrinkage" of the perimeter around panels 21, and 22 as shown in FIG. 2. This result occurs because all interior panels 21, 22 are connected to respective outside edges of a corner section 16. Corner sections 16 are also moved inwardly thereby releasing (or "stripping") the interior mold 13 from the concrete casting 12. The opposite result occurs when plates 34 and 41 are moved upwardly to the closed casting position.

The length of slot 43 is about 12" with the result that plates 35 and panels 21, 22 will be pulled towards the corner and inwardly about 1 ⅜" if all four corners have corner sections 16 that are lowered simultaneously. If only two diagonal corner sections 16 are employed, with the other diagonal corners being integral with respective end and side walls, the "shrinkage" or inward motion of interior mold apparatus 13 will be about 11/16". The number of holes 42, slots 43, and fasteners 43' used depend upon the height of the mold apparatus 10. This distance can be anywhere from about 2 feet to over 12 feet as necessary. Slots 72 in cross tie 37 (FIG. 3) permit bolts 71 to slide therein and such slots 72 are horizontally elongated slightly to accommodate the expansion and shrinkage of the mold during raising or lowering respectively of a corner section 16.

Figure 4:
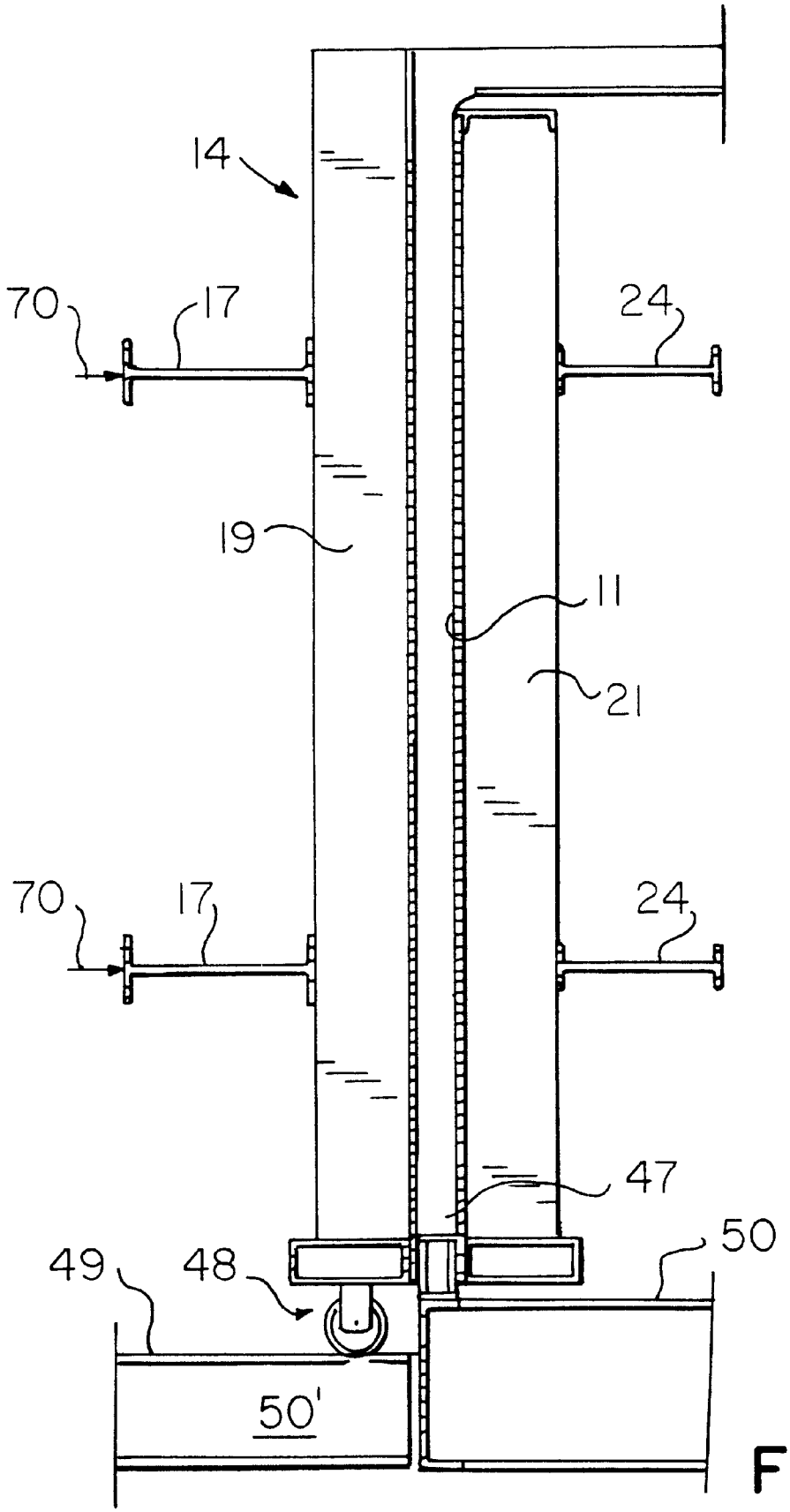
FIG. 4 is a partial side view of the inside and outside forming jackets and the base and roller guide.
Figure 6:
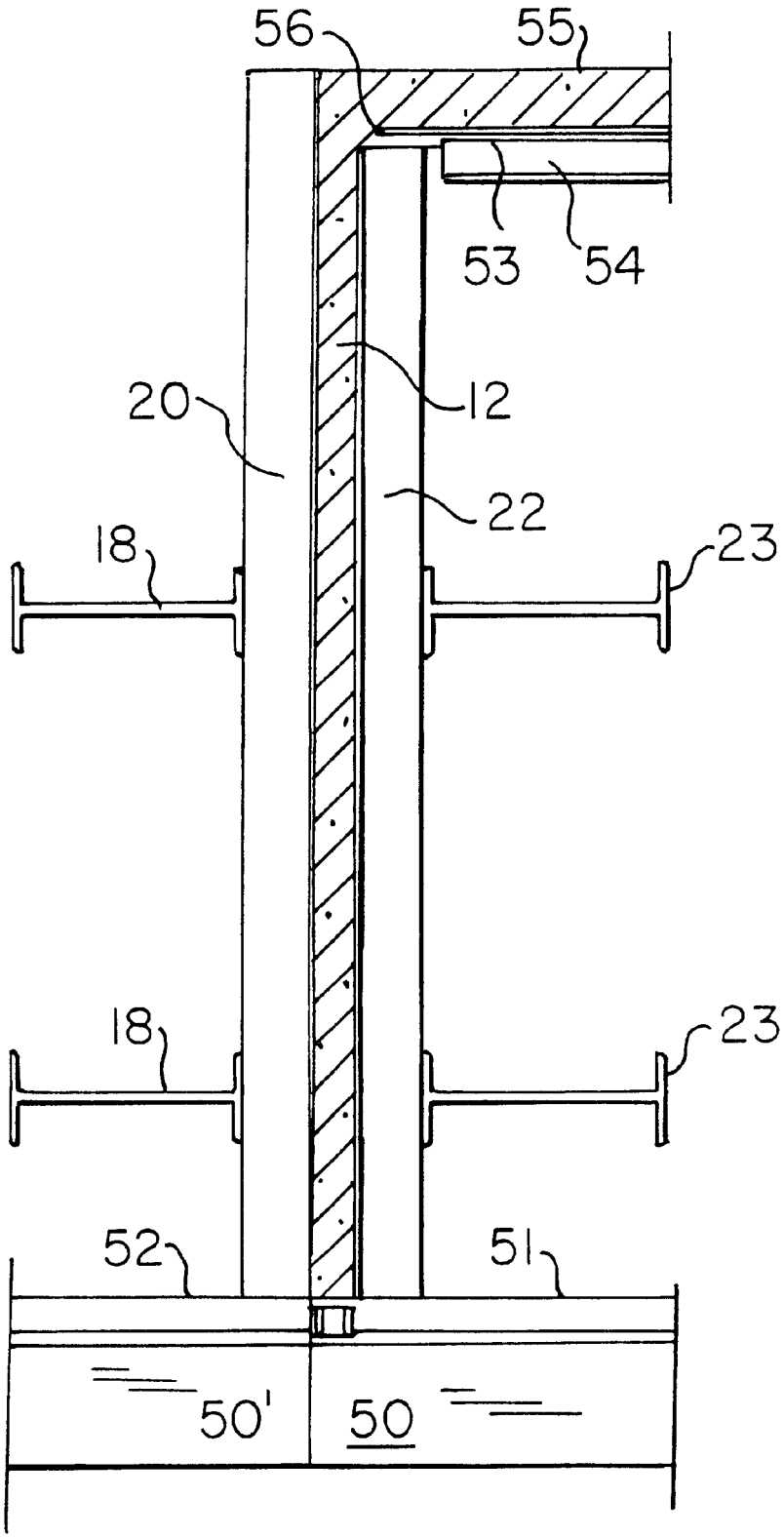
FIG. 6 is a cross section of the system taken on the line 6—6 of FIG. 1.

FIGS. 4 and 6 illustrate a cross-section showing base 50 having inspection manhole 76 (FIG. 1) upon which the interior portions of the mold rest and the roller guide 49 and roller 48 that allow the outside or exterior mold jacket 14 on exterior base apparatus 50' to be moved to the right in preparation for casing. Any appropriate apparatus indicated by arrows 70 including manual means, which is preferable, can be used against exterior walers 17 to push jacket 14 into position.

Figure 4A:
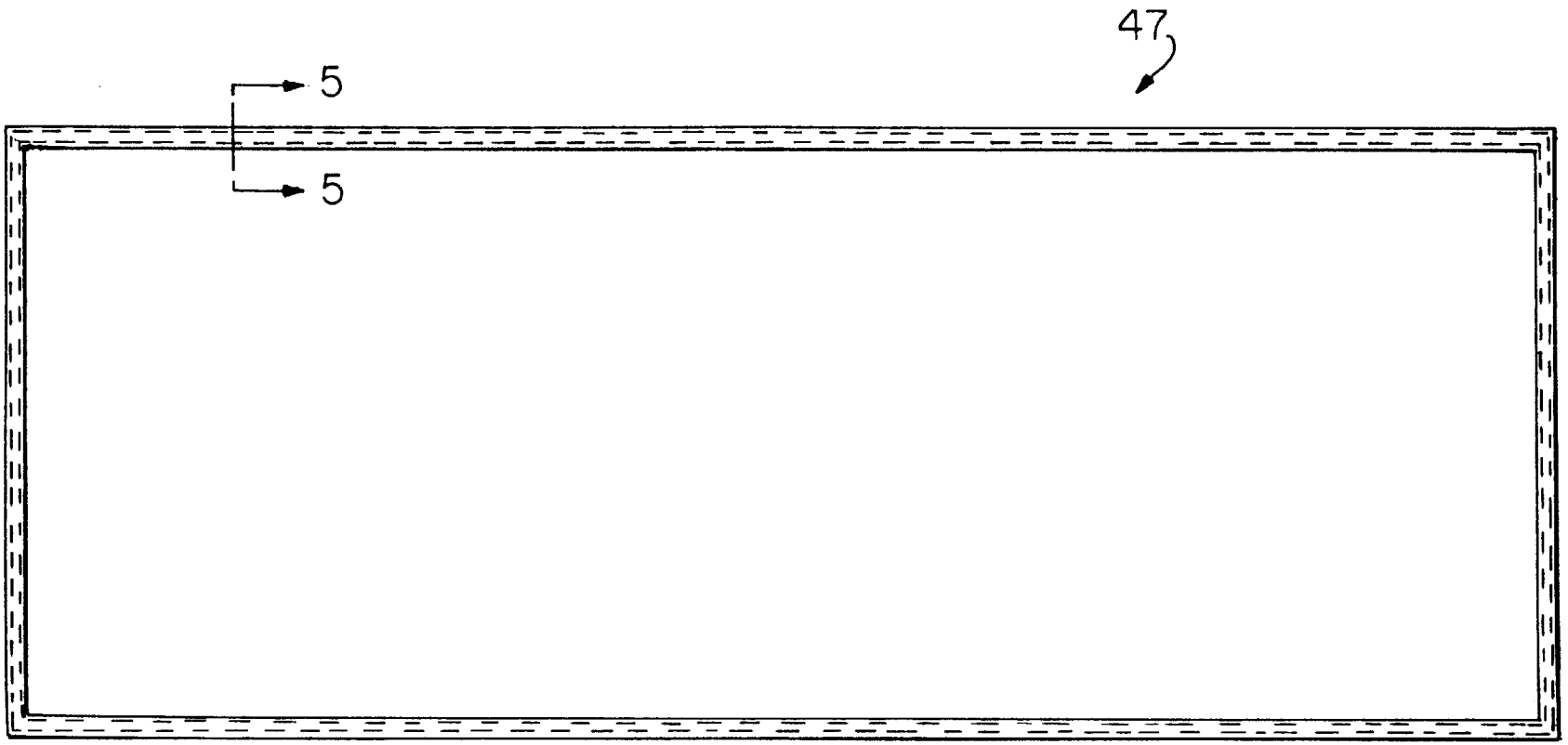
FIG. 4A is a top view of the pallet used in FIGS. 1 and 2.
Figure 5:
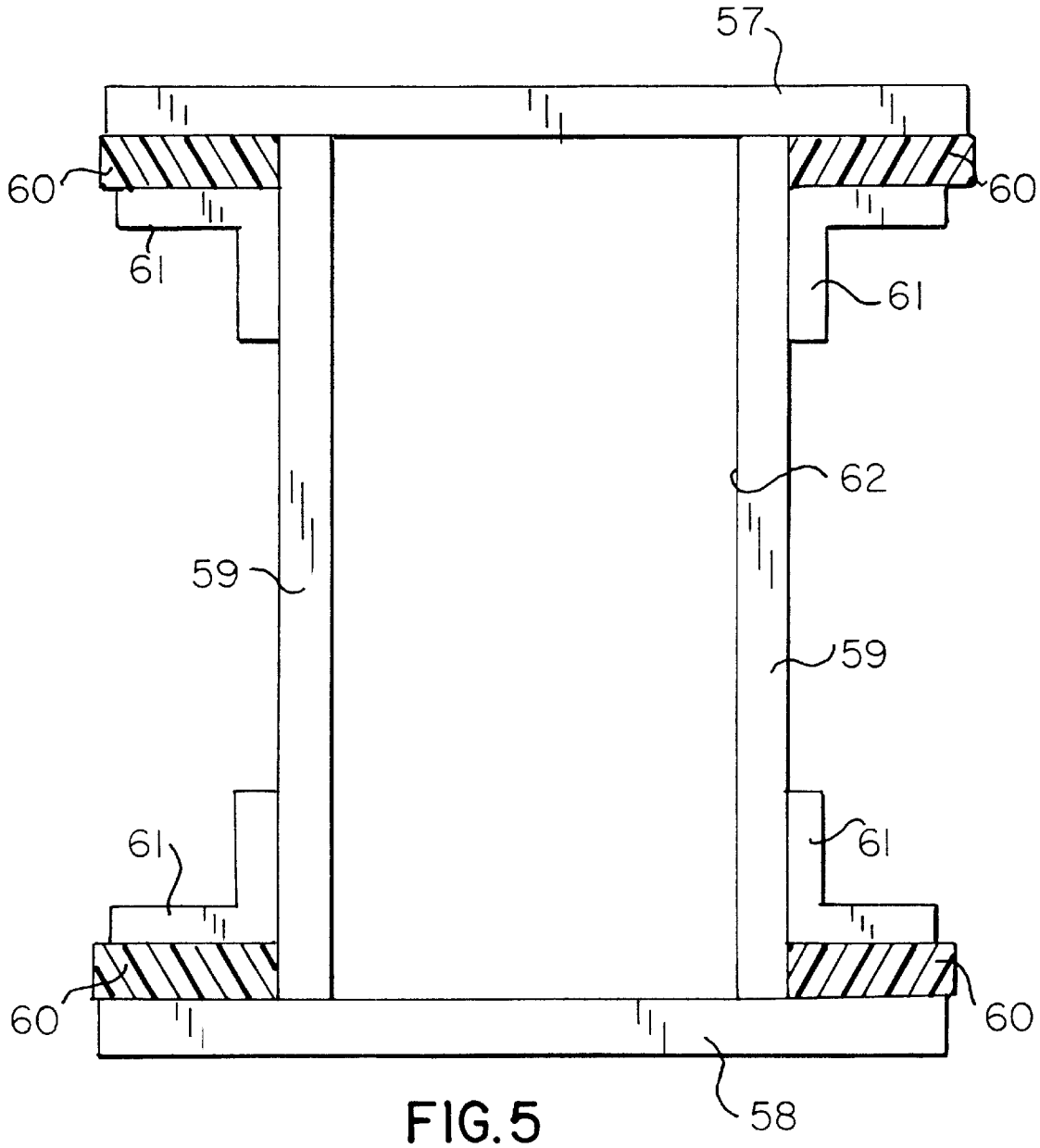
FIG. 5 is a cross-section of the pallet taken on the line 5—5 of FIG. 4A.

FIGS. 4A and 5 illustrate the pallet 47 which can be rectangular as shown or square depending on the mold desired. The pallet 47 is comprised of a top flat bar 57 and bottom flat bar 58. Steel side walls 59 define interior space 62 and support four flanges 61 that enclose gaskets 50 that extend beyond the edge of plates 57 and 58 about 1/16" to provide for sealing the pallet 47 against grout. The pallet 47 is shown having a flat top surface but it is to be understood that other cross-sectional shapes may be desired.

Figure 9:
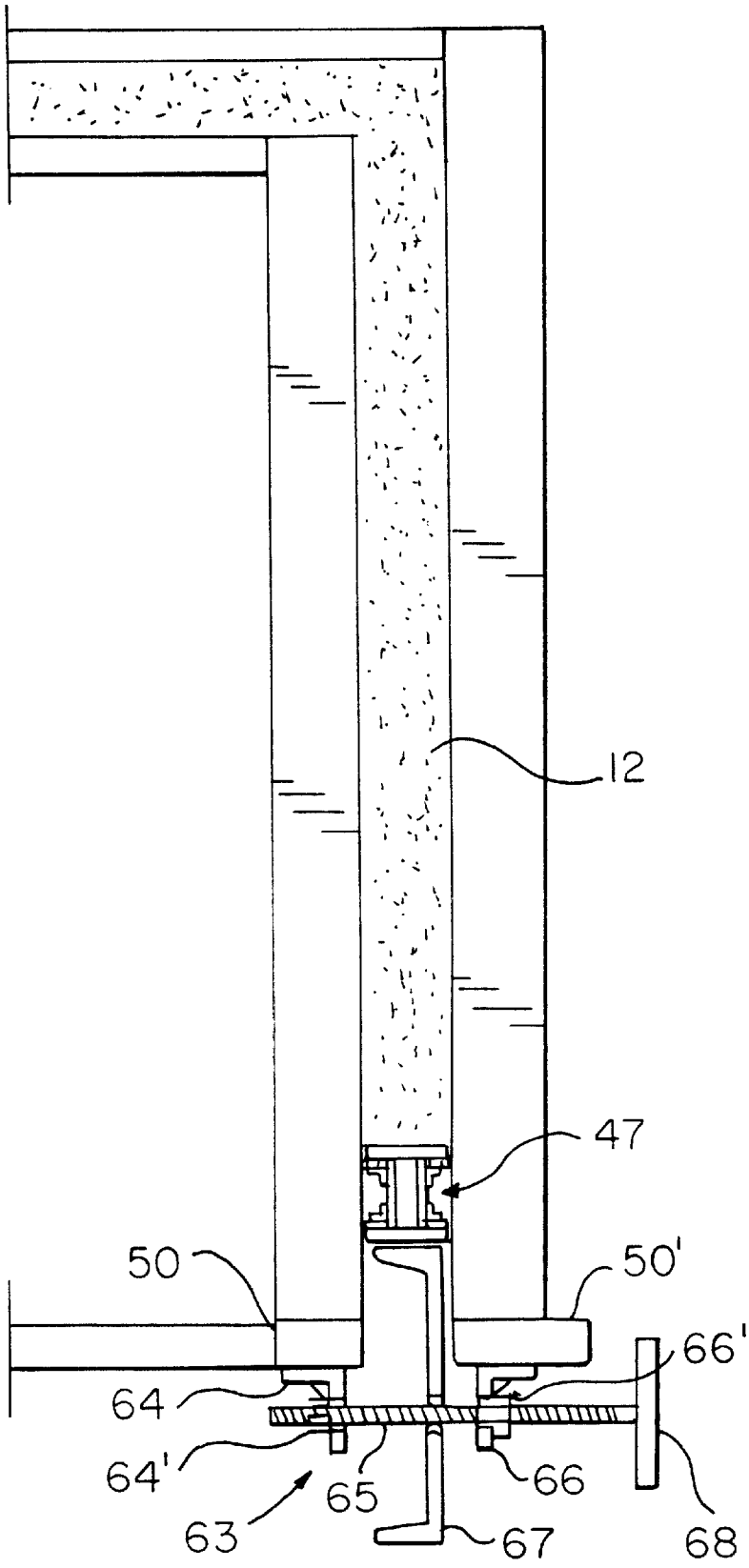
FIG. 9 is a partial cross-section of the apparatus of FIGS. 1 and 2 illustrating the pallet support apparatus.

FIG. 9 illustrates the pallet 47 and its associated operating assembly. A clamping assembly 63 includes brackets 64 and 66 welded to base 50 and 50' and associated welded nuts 64', 66' that support threaded rod 65 which may be turned via handle 68. Flange 67 will raise or lower pallet 47 as the handle 67 is turned to position one or the other end of flange 67 into place to adjust for a different wall height of the casting 12.

In small castings only two corner sections 16 normally would be "live", that is, have a sliding skin plate 41. These sections 16 would be positioned opposite and diagonally across the apparatus 10. In larger applications, all four corners will have "live" corner sections 16 to provide greater control and movement of the interior apparatus 13 during opening and closing of the assembly 10.

Referring to FIG. 3, cross tie squaring bar 37 provides for proper alignment of skin plates 44 during upward or downward movement of corner assembly 16. This prevents one of the interior forming panels 21 and 22 from moving independently and possibly damaging the casting 12 and otherwise causing jamming of the sliding plates 34 and 41 during movement. More than one bar 37 can be used if necessary in very large molds, i.e., a casting that has tall side walls.

Another aspect of the present invention that assists in alignment and the prevention of jamming is the offset or overlapping positions of the connection or interface 79 between respective plates 41 and plates 44 as seen in FIG. 3. Plate 34 extends over the interface 79 of plates 41 and 44 to prevent grout from leaking into the interface 79 and possibly jamming the apparatus in and around slots 43 and bolt holes 42.

Teflon-coated nuts 74 used with bolts 73 (FIG. 8) also contribute to low friction movement of plate 41 and thereby contributes to maintaining alignment and jam-free operation. In addition, slots 43 are accurately machined rather than being "burned in" by torch and thus provide for smoother operation and extended life of the apparatus.

Lubricating system 80 for convenience is shown in FIG. 8 as being supported between mounting bars 86 attached to stiffening members 36. However, since supply 83 is periodically replaced, the same may be centrally located on base 50 as would be apparent to those skilled in the art. Lubricating system 80 includes feeder block 81 to supply grease via a plurality of hoses 82 from the pump and supply system shown generally at 83 which is well known in the lubricating art. Grease is supplied via fittings 85 to grease ports 84 for corner forming section 16. The block 81 also supplies grease to ports 87 (FIG.3) in grease rail 32 upon which lid 53 rests. This grease forms a seal between the removable lid 53 and grease rails 32 which assists in excluding grout intrusion.

Pump system 80 may provide grease to the entire assembly or only to one or more sections 16. Hydraulic plant 88 (shown only in FIG. 1) is standard as understood in the art and operates each of double-acting hydraulic cylinders 39 via lines 89 in a conventional manner. The plant 88 may be mounted on base 50 or elsewhere as desired.

Also, as understood in the art, a pneumatic system may be used for control of the movement of corner sections 16, but it is preferred to use a hydraulic system particularly for large casting mold system.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. An apparatus for integrally casting a multi sided monolithically poured concrete module having a plurality of side walls comprising a pallet for defining the cross-sectional shape and thickness of the side walls, an inside mold core disposed interiorly of said pallet including a plurality of interior panels having opposite end portions for molding inside surfaces of the side walls, a plurality of corner forming sections located between respective said opposite end portions of two adjacent said interior panels for molding inside surfaces of side walls and corners formed thereby, means for moving each said corner forming section downwardly to strip each said section from a concrete module and for locating said interior panels downwardly to position said panels away from a concrete module in an open release position, said means for moving being operable to slide said corner forming section upwardly to a closed casting position abutting said pallet and said interior panels outwardly abusing said pallet to a closed casting position, alignment means located between an adjacent pair of interior panels for maintaining said pair of adjacent said interior panels and said corner forming section therebetween in alignment during movement of said corner forming section and said interior panels, a movable outside mold jacket disposed outwardly of said pallet and arranged to generally envelope said pallet and said inside mold core for molding outside surfaces of side walls to a concrete module, and means for moving said mold jacket between a closed casting position abutting said pallet and an open release position away from said pallet, said jacket and said core defining a mold cavity therebetween for receiving the concrete when said core and said jacket are in said closed casting positions, a pair of sliding connection means, each said sliding connection means including an ear side skin plate slideably mounted to an interior surface of respective said corner forming section each said ear side plate having elongate opposite edges, each said corner forming section including a pair of slide plates and a skin plate having opposite edges, said skin plate slideably abutting one said edge of each said ear skin plate, each said slide plate overlapping an interior surface of interfaces defined between said one edge of each said ear skin plate and one of respective said edges of said skin plate, each said one edge of said ear skin plate slideably abutting respective said one edge of said skin plate to minimize the entrance of debris into said interfaces and interfering with respective said sliding, connection means, and a base for supporting said mold core above a supporting surface of said apparatus to provide clearance space for downward movement of said corner forming sections into said open release position.

2. The apparatus as defined in claim 1 wherein each said corner forming section includes a movable wedge-shaped element with an upper apex portion and a lower base portion having a width greater than said apex portion and two slanted edges and engaging means for connecting said element to said interior panels for causing said interior panels to be moved inwardly when said element is moved substantially vertically downwardly and for causing said interior panels to be moved outwardly when said element is moved substantially vertically upwardly to said closed casting position.

3. The apparatus as defined in claim 1 wherein said alignment means includes an elongated bar member having opposite end portions and means for movably mounting each said end portion of said bar member to a respective said interior panel, said bar member being mounted generally horizontally.

4. The apparatus of claim 3 wherein said means for movably mounting includes a pair of generally horizontally extending slots and cooperating fixed bolts located through said slots.

5. An apparatus for integrally casting a multi sided monolithically poured concrete module having a plurality of side walls and a top wall integral therewith comprising a pallet for defining the cross-sectional shape and thickness of the side walls, an inside mold core disposed interiorly of said pallet and including a plurality of interior panels having opposite end portions for molding inside surfaces of the side walls of a concrete module, a plurality of corner forming sections located between respective said opposite end portions of two adjacent said interior panels for molding inside surfaces of the side walls and corners formed thereby, a lid supported by said inside mold core for molding a top wall integrally with the plurality of side walls, means for moving said corner forming section downwardly to strip each said section from a concrete module and for locating said interior panels inwardly to position said panels away from a concrete module in an open release position, said means for moving being operable to slide said corner forming section upwardly to a closed casting position abutting said pallet and said interior panels outwardly abutting said pallet to a closed casting position, alignment means attached between an adjacent pair of said interior panels for maintaining said pair of adjacent said interior panels and said corner forming section therebetween in alignment during movement of said corner forming section, a movable outside mold jacket disposed outwardly of said pallet and arranged to generally envelope said pallet and said core for molding outside surfaces of side walls can't read concrete module, and means for moving said mold jacket between a closed casting position abutting said pallet and an open release position away from said pallet, said jacket and said core defining a mold cavity therebetween for receiving concrete when said core and said jacket are in said closed casting positions and said lid is supported by said core, a pair of sliding connection means each said sliding connection means including an ear side skin plate slideably mounted to an interior surface of respective said corner forming section each said ear side plate having elongate opposite edges, each said corner forming section including a pair of slide plates and a skin plate having opposite edges, said skin plate slideably abutting one said edge of each said ear skin plate each said slide plate overlapping an interior surface of interfaces defined between said one edge of each said ear skin plate and one of respective said edges of said skin plate, each said one edge off said ear skin plate slideably abutting respective said one edge of said skin plate to minimize the entrance of debris into said interfaces and interfering with respective said sliding connection means and means for supporting said mold core above a supporting surface of said apparatus to provide clearance space for downward movement of said corner forming sections into said open release position.

6. The apparatus as defined in claim 5 wherein each said corner forming section includes a movable corner member for forming an interior concrete corner, said means for moving said interior panels and said corner forming section including means for moving said corner member substantially vertically upward to said closed casting position and substantially vertically downwardly to said open release position.

7. The apparatus as defined in claim 5 wherein each said corner forming section includes means for movably attaching said corner forming section to each said adjacent interior panels, said means for moving said interior panels and said corner forming section substantially vertically upwardly and outwardly to a closed casting position and substantially vertically downwardly and inwardly to an open release position.

8. The apparatus as defined in claim 5 wherein said alignment means includes an elongated bar member having opposite end portions and means for movably mounting each said end portion of said bar member to a respective said interior panel, said bar member being mounted generally horizontally.

9. The apparatus as defined in claim 5 wherein each said corner-forming section includes a movable wedge-shaped element with an upper apex portion and a lower base portion having a width greater than said apex portion and two slanted edges and engaging means for connecting said element to said interior panel for causing said interior panels to be moved inwardly when said element is moved substantially vertically downwardly to said open release position and for causing said interior panels to be moved outwardly when said element is moved substantially vertically upwardly to said closed casting position.

10. An apparatus for integrally casting a multitude monolithically poured concrete module having a plurality of side walls comprising a pallet for defung the cross-sectional shape and thickness of the side walls, an inside mold core disposed Interiorly of said pallet and including a plurality of interior panels having opposite end portions for molding inside surfaces of the side walls, a plurality of corner forming sections each being locked between respective said opposite end portions of two adjacent said interior panels for molding inside surfaces of side walls and corners formed thereby of a concrete module, means for moving said interior panels inwardly and said corner forming sections outwardly and upwardly and inwardly and downwardly between a closed casting position and an open release position, said inside mold core abutting against said pallet in said closed casting position and movable to said open release position, alignment means attached between an adjacent pair of said interior panels for maintaining said pair of adjacent said interior panels and said adjacent corner forming section in alignment during movement of said corner forming section, an outside mold jacket disposed outside of said pallet including a plurality A of exterior panel members cooperatively arranged to generally, envelope said pallet and said inside mold core for molding outside surfaces of side walls of a concrete module, and means for moving each of said exterior panel members between a closed casting position abutting said pallet and an open release position away from said pallet, said outside mold jacket and said inside mold core defining a mold cavity therebetween for receiving the concrete when said mold core and said mold jacket are in said closed casting positions, a pair of sliding connection means, each said sliding connection means including an ear side skin plate slideably mounted to an interior surface of respective said corner forming section each said ear side plate having elongate opposite edges, each said corner forming section including a pair of slide plates and a skin plate having opposite edges, said skin plate slideably abutting one said edge of each said ear skin plate, each said slide plate overlapping an interior surface of interfaces defined between said one edge of each said ear skin plate and one of respective said edges of said skin plate, each, said one edge of said ear skin plate slideably abutting respective said one edge of said skin plate if the entrance of debris into said interfaces and interfering with respective said sliding connection means, and base means for supporting said mold core above a supporting surface of said apparatus to provide clear space for downward movement of said corner fonning sections into said open release position.

11. The apparatus as defined in claim 10 wherein each said corner forming section includes a movable corner member for forming an interior concrete corner, said means for moving said interior panels and said corner forming section including means for moving said corner member substantially vertically upward to said closed casting position and substantially vertically downwardly to said open release position.

12. The apparatus as defined in claim 11 wherein said means for moving said corner member includes a hydraulic cylinder attached between said corner member and another part of said apparatus.

13. The apparatus as defined in claim 10 wherein each said corner forming section includes means for movably attaching said corner forming section to each said adjacent interior panels, said means for moving said interior panels and said corner forming sections including means for moving each said corner forming section substantially vertically upwardly and outwardly to a closed casting position and substantially vertically downwardly and inwardly to an open release position.

14. The apparatus as defined in claim 10 wherein each said skin plate is formed as a movable wedge-shaped element having opposite edges with an upper apex portion and a lower base portion having a width greater than said apex portion, said edges of said skin plate being slanted, one said edge of said each ear skin plate being slanted and located adjacent one said edge of said element and each said ear skin plate having another substantially vertical edge portion attached to one said interior panel, and engaging means for slideably connecting one said slanted edge portion of one said end portion of one said ear skin plate for causing salid interior panels attached to said ear skin plate to be moved inwardly when said element is moved substanially vertically downwardly to said open release position and for causing said interior panels to be moved outwardly when said element is moved substantially vertically upwardly to said casting position.

15. The apparatus as defined in claim 10 wherein said alignment means includes an elongated bar member having opposite end portions and means for movably mounting each said end portion of said bar member to a respective said interior panel, said bar member being mounted generally horizontally.

16. The apparatus of claim 15 wherein said means for movably mounting includes a pair of generally horizontally extending slots and cooperating fixed bolts located through said slots.

17. The apparatus of claim 14 wherein said engaging means includes at least one elongated slot in one said slanted edge portion and at least one bolt extending through said slot and movably therealong.

18. The apparatus of claim 14 wherein said engaging means includes at least two spaced and aligned elongated slots in one said slanted edge portion and at least two spaced bolts extending through respective said slot and movable therealong.

19. The apparatus as defined in claim 10 wherein said means for moving said interior panels and said corner forming sections includes lubricating means for lubricating between said corner forming sections and said respective opposite end portions of said adjacent interior panels.

20. The apparatus as defined in claim 14 futher comprising lubricating means for lubricatng between said slanted edge portions of said element and said ear skin plate.

* * * * *